US005560223A

United States Patent [19]

Le Bihan

[11] Patent Number: 5,560,223

[45] Date of Patent: Oct. 1, 1996

[54] PROCESS AND INSTALLATION FOR THE EXPANSION AND COMPRESSION OF AT LEAST ONE GASEOUS STREAM

[75] Inventor: Hervé Le Bihan, Sucy-En-Brie, France

[73] Assignee: L'Air Liquide, Societe Anonyme pour l'Etude et l'Exploitation des Procedes Georges Claude, Paris Cedex, France

[21] Appl. No.: 420,801

[22] Filed: Apr. 12, 1995

[30] Foreign Application Priority Data

Oct. 25, 1994 [FR] France ..... 94-12715

[51] Int. Cl.[6] ..... F25J 3/02

[52] U.S. Cl. ..... 62/649; 62/910

[58] Field of Search ..... 62/38, 39

[56] References Cited

U.S. PATENT DOCUMENTS

| | | | |
|---|---|---|---|
| 3,950,957 | 4/1976 | Zakon | 62/39 X |
| 4,133,662 | 1/1979 | Wagner | 62/39 X |
| 4,775,399 | 10/1988 | Erickson | 62/38 X |
| 5,157,926 | 10/1992 | Guilleminot | 62/38 X |
| 5,329,776 | 7/1994 | Grenier | 62/38 X |
| 5,365,741 | 11/1994 | Roberts et al. | 62/38 |
| 5,400,600 | 3/1995 | Grenier | 62/38 X |

*Primary Examiner*—Christopher Kilner
*Attorney, Agent, or Firm*—Young & Thompson

[57] ABSTRACT

Process and installation for the compression and expansion of at least one gaseous stream, in which a first stream of a gaseous mixture is compressed in a compressor (5) having at least one compression stage (5A, 5B, 5C); a second stream of a gaseous mixture is supercharged in a supercharger (7); a third stream of a gaseous mixture is expanded in an expansion engine (9); at least a portion of the energy generated by the expansion engine is recovered with the supercharger (7) and at least a portion of the second supercharged stream is sent upstream of one stage (5B) of the compressor. The first and second streams are compressed in at least one stage (5A) of the compressor before sending the second stream to the supercharger. The second stream comes from upstream of one stage of the compressor and at least a portion of the supercharged second stream is returned downstream of this stage. The point of origin of the second stream and the point of return of this latter are separated by at least one compression stage. The first stream and the second stream are distilled, after compression, in a distillation apparatus, and the third stream is a gaseous product withdrawn from the apparatus.

12 Claims, 1 Drawing Sheet

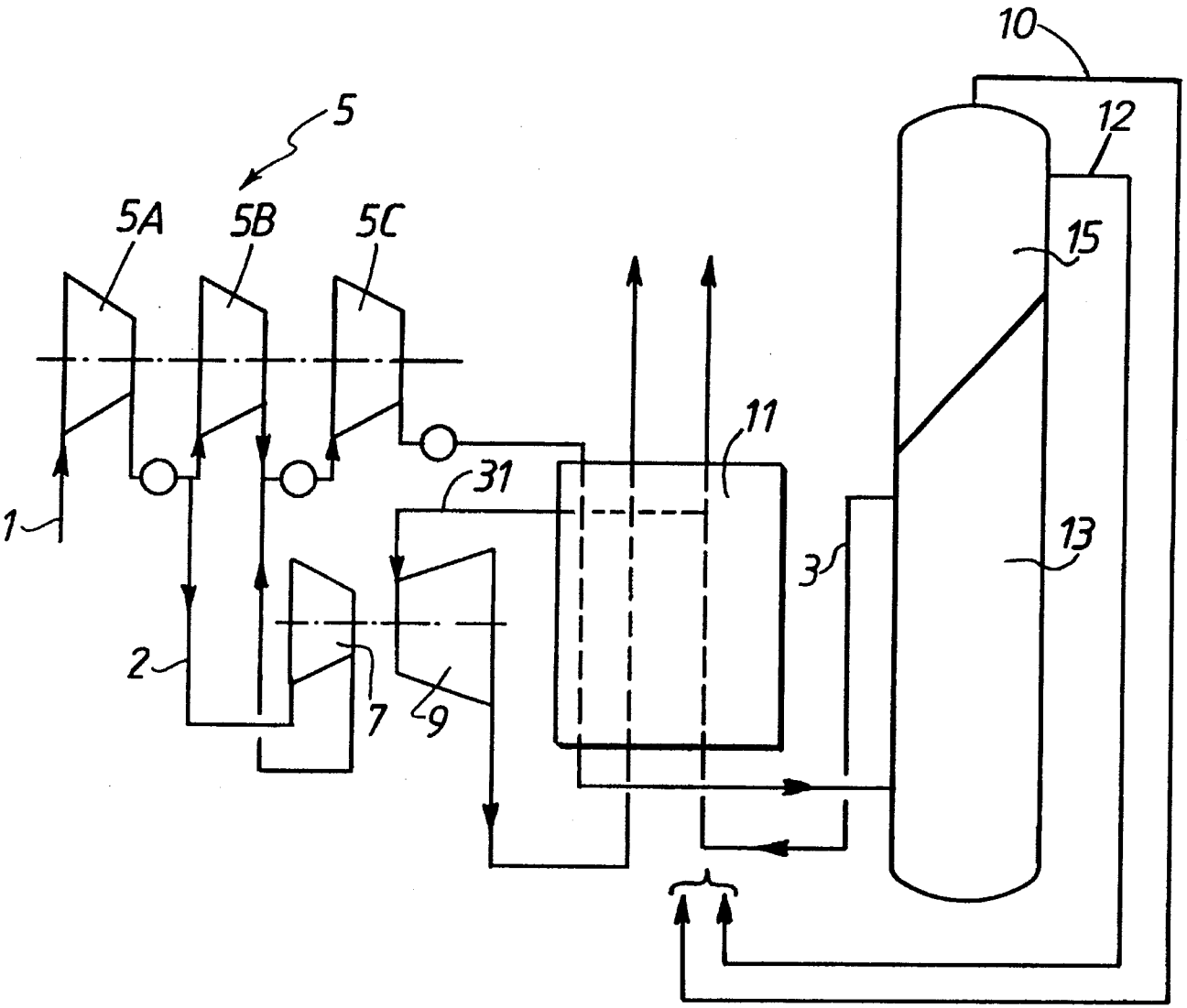
10
12
15
13
3
11
31
9
7
5
5C
5B
5A
2
1

PROCESS AND INSTALLATION FOR THE EXPANSION AND COMPRESSION OF AT LEAST ONE GASEOUS STREAM

FIELD OF THE INVENTION

The present invention relates to a process and an installation for the compression and expansion of at least one gaseous stream, which process is of the type according to which:

a first stream of a gaseous mixture is compressed in a compressor having at least one stage;

a second stream of the gaseous mixture is supercharged in a supercharger;

a third stream of a gaseous mixture is expanded in an expansion engine; and at least a portion of the energy generated by the expansion engine is recovered with the supercharger.

BACKGROUND OF THE INVENTION

EP-A-0.557.935 discloses a process of this type, in which the first stream is of the air to be distilled, the second stream is of the nitrogen at medium pressure supercharged by the supercharger 110 and the third system is a residual gas expanded in the turbine 113 which is coupled with the supercharger.

DE-A-28.54.508 discloses a process of this type, in which a portion of the air is first supercharged in the supercharger then expanded in a turbine coupled with the supercharger, then sent to the low pressure column of a double column.

These processes, increasing the expansion load in the turbine, permit reducing the work expanded flow with a given production of cold or increasing the production of cold with a constant expanded flow rate with, in general, an improvement of the performance of the installation.

In certain cases, there is no simple means for carrying out a process of this type or simply of recovering with a supercharger the mechanical energy produced by the turbine. For example, when the turbine expands nitrogen withdrawn from the medium pressure column of an air separation installation, it is less interesting to reheat this nitrogen, available at low temperature so as to compress it and then cool it to send it to the turbine, which increases the capital cost of the heat exchange line.

DE-A-25.57.453 discloses a solution to this problem with a process according to which the second stream constitutes a fraction of the first stream, which is the air to be distilled. The supercharger 5 of the second stream is coupled to a turbine 6 which serves to expand the gaseous nitrogen at medium pressure (the third stream).

Again in the case of DE-A-28.54.508, it can happen that the desired cold production requires a work expanded flow less than or equal to that which permits distillation. In this case, the reduction of the work expanded air flow gives rise to no saving and there is accordingly no interest in increasing the intake pressure of the turbine because there is no interest in reducing the work expanded flow rate that results.

The prior art thus teaches recovering the energy of the turbine with a generator or to dissipate the energy with an oil brake.

SUMMARY OF THE INVENTION

The invention has for its object to improve the energy performance or to reduce the capital cost of these known processes.

To this end, the invention has for its object a process of the recited type, characterized in that:

at least a portion of the second supercharged flow is sent upstream of a stage of the compressor.

The invention also has for its object an installation for the compression and expansion of at least one gaseous stream comprising:

a compressor with at least one stage;

a supercharger;

an expansion engine coupled to be supercharger;

means to send a first stream of a gaseous mixture to the compressor;

means to send a second stream of a gaseous mixture to the supercharger and to send at least a portion of the second supercharged stream upstream of a stage of the compressor; and means to send a third stream to the intake of the expansion engine.

BRIEF DESCRIPTION OF THE DRAWINGS

Other characteristics and advantages of the present invention will become apparent from the following description of one embodiment given by way of illustration but in no way limiting, with respect to the accompanying drawing, in which:

the single FIGURE shows schematically an installation according to the invention.

DETAILED DESCRIPTION OF THE INVENTION

An air stream is sent to a compressor 5 with several stages 5A, 5B, 5C. After being compressed in a first stage 5A, the stream is divided in two. A first stream is compressed in the second stage 5B. A second stream is supercharged in a supercharger 7 to a pressure in the neighborhood of that of the stage 5B then mixed with the first stream. All the reconstituted air flow is compressed in stage 5C before being cooled in the heat exchange line 11 and sent to the distillation column 13, there to be separated.

One of the products of the separation is a nitrogen stream 3 withdrawn from the head of the medium pressure column 13 at a pressure of about 6 bars. After having been partially reheated in the heat exchange line 11, a fraction 31 is expanded to a pressure in the vicinity of atmospheric pressure in the turbine 9 and then sent to the cold end of the heat exchange line in which it is reheated, giving up its cold to the air stream destined for distillation. The turbine 9 is coupled to the supercharger 7 and therefore a portion of the expansion energy serves to supercharge the second air stream 2.

As a modification, a fraction of the impure 10 or pure 12 nitrogen withdrawn from the low pressure column of a double column under pressure can be work expanded, after partial reheating in the heat exchange line 11 and this nitrogen could be sent to the cold end of the heat exchange line 11.

As another modification, at least a portion of the nitrogen produced in a simple HPN type column, or the residue, can be work expanded after vaporization in the head condenser of this column. The nitrogen or the residue is partially reheated in the heat exchange line.

There could also be envisaged the use of a second supercharger coupled either to the turbine 9 or to an independent turbine. This second supercharger would be supplied with air withdrawn upstream from stage 5A, at least a portion of the supercharged air being returned upstream of the stage 5B and downstream of stage 5A.

By varying the compression load of the supercharger 7 and of the compressor stages 5, the supercharged gas flow could be returned to the output of stage 5C, instead of to that of stage 5B.

In a more simple manner, the invention could be carried out in an installation comprising a single stage compressor, a supercharger and a turbine coupled to the supercharger. A first stream of a gaseous mixture would be compressed in the compressor and a second stream of a gaseous mixture in the supercharger, the two compressed streams of gaseous mixture then being mixed together.

It is to be noted that the gaseous mixtures can be substantially pure gas and that the gaseous mixtures compressed by the compressor and the supercharger are not necessarily of the same composition.

I claim:

1. Process for the compression and expansion of at least one gaseous stream, comprising a) compressing a first stream of a gaseous mixture in a compressor having at least one compression stage;

b) supercharging a second stream of a gaseous mixture in a supercharger;

c) expanding with the production of external work a third stream of a gaseous mixture in an expansion engine;

d) recovering at least a portion of the energy generated by the expansion engine with the supercharger and e) sending at least a portion of the second supercharged stream upstream of one stage of the compressor.

2. Process according to claim 1, wherein the first and second streams are compressed in at least one stage of the compressor before sending the second stream to the supercharger.

3. Process according to claim 2, wherein said at least one compressor stage is the first stage of a plural-stage compressor.

4. Process according to claim 2, wherein the second stream comes from upstream of one stage of the compressor and at least a portion of said supercharged second stream is returned downstream of this stage.

5. Process according to claim 4, wherein the point of origin of the second stream and the point of return of said second stream are separated by at least one compression stage.

6. Process according to claim 1, further comprising distilling the first stream and the second stream, after compression, in a distillation apparatus, and withdrawing the third stream as a gaseous product from the distillation apparatus.

7. Process according to claim 6, wherein the first and the second streams are air streams.

8. Process according to claim 7, wherein the third stream is one of nitrogen withdrawn from a medium pressure column of the distillation apparatus, and impure nitrogen withdrawn from a low pressure column of a double distillation column under pressure.

9. Installation for the compression and expansion of at least one gaseous stream comprising:

a compressor with at least one stage;

a supercharger;

an expansion engine coupled to the supercharger;

means to send a first stream of a gaseous mixture to the compressor;

means to send a second stream of a gaseous mixture to the supercharger and to send at least one portion of the second supercharged stream upstream of one stage of the compressor; and means to send a third stream to the inlet of the expansion engine to drive the supercharger.

10. Installation according to claim 9, wherein the first and second streams are air streams, and an air distillation apparatus that distills said air streams, the third stream being a product of said distillation apparatus.

11. Installation according to claim 9 wherein, the compressor has three stages comprising a first stage to compress the first and the second streams, means to send the second stream from the first stage to the supercharger and means to send the first stream to the second and a third stages and at least one portion of the supercharged second stream to the third stage.

12. Installation for the separation of a gaseous mixture by cryogenic distillation comprising:

a compressor having at least one stage;

a supercharger;

an expansion engine coupled to the supercharger;

means to send a first stream of a gaseous mixture to the compressor;

means to send a second stream of a gaseous mixture to the supercharger and to send at least a portion of the supercharged second stream downstream of a stage of the compressor; and means to send a third stream of a gaseous mixture to the inlet of the expansion engine to drive the supercharger.

* * * * *